United States Patent [19]

Masui et al.

[11] Patent Number: 4,565,236

[45] Date of Patent: Jan. 21, 1986

[54] METHOD OF AND MOLD FOR CONTINUOUSLY CASTING STEEL BEAM BLANKS

[75] Inventors: Tamenori Masui; Hitoshi Ono, both of Sakai; Toshihiko Ariyoshi, Kitakyushu, all of Japan

[73] Assignee: Nippon Steel Corporation, Tokyo, Japan

[21] Appl. No.: 347,023

[22] Filed: Feb. 8, 1982

[30] Foreign Application Priority Data

Feb. 10, 1981 [JP] Japan ..... 56-17544

[51] Int. Cl.[4] ..... B22D 11/04

[52] U.S. Cl. ..... 164/459; 164/418

[58] Field of Search ..... 164/418, 459

[56] References Cited

U.S. PATENT DOCUMENTS

| | | | |
|---|---|---|---|
| 2,579,691 | 12/1951 | Narrow | 164/418 |
| 2,975,493 | 3/1961 | Morton et al. | 164/418 X |
| 3,416,222 | 12/1968 | Pearson | 164/418 X |
| 3,528,485 | 9/1970 | Vogel | 164/418 |
| 3,559,720 | 2/1971 | Vogel et al. | 164/418 |
| 3,791,015 | 2/1974 | Lucenti | 164/418 X |
| 3,910,342 | 10/1975 | Johnson | 164/418 |
| 4,207,941 | 6/1980 | Shrum | 164/418 X |

FOREIGN PATENT DOCUMENTS 56-109146 8/1981 Japan .

OTHER PUBLICATIONS

Lucenti, G. S., "The Continuous Casting of Beam Blanks at the Algoma Steel Corporation, Limited", *Blast Furnace and Steel Plant* for Jan., 1970, pp. 19–32.

*Primary Examiner*—Nicholas P. Godici
*Assistant Examiner*—J. Reed Batten, Jr.
*Attorney, Agent, or Firm*—Cushman, Darby & Cushman

[57] ABSTRACT

For alleviating the problem in continuous casting of beam blanks that cracks are frequently formed at the fillet parts thereof not only is the mold cavity provided with a taper at its web part in the casting direction, but also the curvature 1/R of the curved fillet parts of the mold cavity are successively varied in accordance with the amount of free shrinkage of the solidified shell of the beam blank strand. Such variation in curvature is particularly significant in the casting of beam blanks having a web height that is close to 1 m.

9 Claims, 18 Drawing Figures

METHOD OF AND MOLD FOR CONTINUOUSLY CASTING STEEL BEAM BLANKS

The present invention relates to a continuous casting mold for beam blanks which are used as starting material for producing H shapes and I beams.

As is well known, the use of a blooming mill for rough rolling of ingots to produce beam blanks is being replaced by continuous casting.

One of the problems involved in the continuous casting of beam blanks is that the shape of a mold is assimilated so as to resemble as much as possible that of the final product and the forming and deforming behaviour of the solidified shell, formed during the solidification of molten steel in a continuous mold, is complicated, with the result that cracks are liable to form in the strand, particularly at the fillets of the strand. In order to prevent the formation of cracks in the strand, the following methods have been employed: (a) steelmaking method, which is carried out in such a manner that the sensitivity of the solidified shell to cracking is decreased by decreasing the impurities, especially sulfur, of the molten steel; (b) a method in which in order to form a uniform solidified shell as seen in a traversal cross section of a strand, (b-1) casting powder is introduced uniformly between the solidified shell and a continuous casting mold, (b-2) the continuous casting mold is moderately cooled by controlling the cooling water-temperature or-flow rate, (b-3) the solidified shell is uniformly cooled by controlling the distribution of the cooling water as seen in the traversal cross section of the continuous casting mold, and (b-4) horizontal vibration of the continuous casting mold is prevented. In addition, it is necessary to prevent the propagation of cracks after they have formed. In order to achieve this end, a soft secondary cooling method (c) may be carried out by spraying a small amount of cooling water directly below the continuous casting mold.

Furthermore, various continuous casting molds have been proposed which are designed to be specifically adaptable to the casting of beam blanks. Before describing these molds, the behaviour or actions of the solidified shell during casting will be explained with reference to FIGS. 1 through 4.

Figure 1:
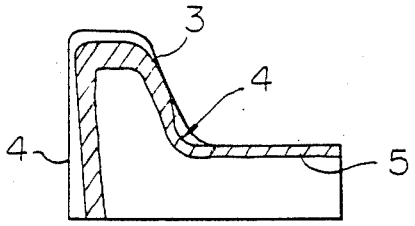
Fig. 1 (PRIOR ART)
FIGS. 1 through 4 are drawings of a quarter of a beam blank and illustrate schematically the deformation of the solidified shell during casting.

Referring to FIG. 1, the deformation of a solidified shell 3 is illustrated on the presumption that the solidified shell has been solidified without being constrained by the continuous casting mold. Under such conditions, the web shell 5 shrinks, thereby causing a part of the solidified shell 3 to separate from the inner flanges 4 of the continuous casting mold.

Figure 2:
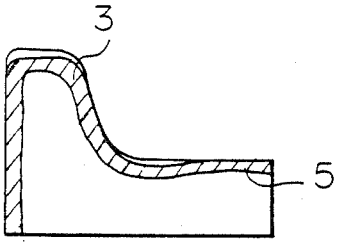
Fig. 2 (PRIOR ART)

Referring to FIG. 2, the deformation of a solidified shell 3 is illustrated, taking into consideration of restriction due to the both inner flanges of continuous casting mold. The solidified shell 3 is subjected to tension stress and thus is deformed, with the result that a gap is formed between the inner part of the continuous casting mold and the web shell 5. Since the cooling is not uniform, the web shell 5 tends to be locally thinner than the other parts of the solidified shell and to be subjected to tensile stress concentration, which results in the formation of cracks.

Figure 3:
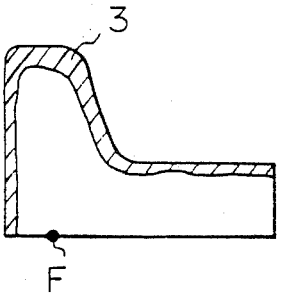
Fig. 3 (PRIOR ART)

Referring to FIG. 3, the molten steel is generally poured into spots F, one of which is shown in FIG. 3. The flow of molten steel may, however, occasionally be irregular, and, in this case, local erosion of the solidified shell 3 takes place or the solidification becomes locally slow, with the result that the solidified shell becomes locally thinner.

Figure 4:
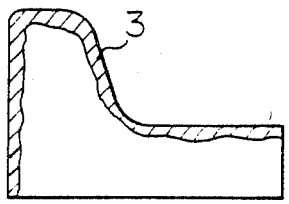
Fig. 4 (PRIOR ART)

Referring to FIG. 4, the thickness of the solidified shell 3 is not uniform along the continuous casting mold wall. This is because complete, uniform cooling around the continuous casting mold wall is not realized, and, thus, the solidified shell does not develop satisfactorily in the regions of the continuous casting mold where cooling is inadequate. Since the solidified shell during continuous casting is considered to deform or develop in the manner shown in FIGS. 1 through 4, stress concentration is liable to occur in the thin regions of the solidified shell and result in the formation of cracks. The above-described steelmaking method (a) and continuous casting methods (b), (c) have contributed to eliminating cracks in beam blanks.

Now, regarding the continuous casting mold for beam blanks, several designs of a mold shape have been proposed so as to prevent the formation of cracks. According to one of the proposals, a built-up mold is provided with a larger dimension at an upper part and a smaller dimension at a lower part so as to form a taper in the mold in accordance with the advance of solidification and thus decrease the volume of the strand. Namely, it is described in Japanese Laid Open Patent Application No. 56-109146 that a continuous casting mold for beam blanks is provided, at least at its web part, with such a taper so that the mold gap distance between both surface of mold gradually decreases in the travelling direction of the strand. The aim of providing a taper at at least the web part of the continuous casting mold is to uniformly cool the molten steel during the solidification process. In Blast Furnace And Steel Plant, January 1970, pp 19–32, it is described that beam blank molds are of a solid block 28 inches in length and are provided with a 0.040 inch inverse taper at the web fillets (0.080 inch in total).

Incidentally, the formation of cracks in beam blanks is due to, roughly speaking: the sensitivity of the solidified shell to cracking; a locally thin solidified shell; and, the restriction of a solidified shell to the mold wall. When any cracks are formed in continuous casting, breakout, in which case continuous casting must be interrupted, and a decrease in the strand yield take place. The purpose of the taper in the above-mentioned Blast Furnace and Steel Plant is to achieve a uniform cooling effect by decreasing the inner dimensions of the continuous casting mold and to mitigate restrained cracks. However, such a continuous casting mold is a complicated device and thus is, very difficult to manufacture and is expensive.

Regarding the dimensions of beam blanks which have heretofore been produced, the largest ones have a web inner height of 476 mm at the maximum. If one tries to produce beam blanks having a web inner height exceeding 500 mm, the unfortunate possibility exists that restrained cracks could not be effectively prevented according to the proposals mentioned in items (a), (b) and (c) above. It is to be noted here that although the shrinkage ratio of a solidified shell relative to the web height does not vary according to continuous casting molds having a large or small web height, the amount of shrinkage of the solidified shell is increased with an increase in web height. Therefore, in a large continuous casting mold for beam blanks, the danger of restrained cracks is increased when the solidified shell is of a nonuniform thickness due to nonuniform cooling, and, thus, stress concentration is enhanced in the thin regions of the solidified shell.

The known continuous casting molds involve unsolved problems because they do not satisfactorily prevent the formation of restrained cracks due to shrinkage of the solidified shell at the fillet and web parts thereof.

In the case of continuous casting, the actual deformation and formation of the solidified shell is a synthesis of the deformation and formation of solidified shell illustrated in FIGS. 1 through 4, and the restrained cracks are induced as described with reference to FIG. 5.

Figure 5:
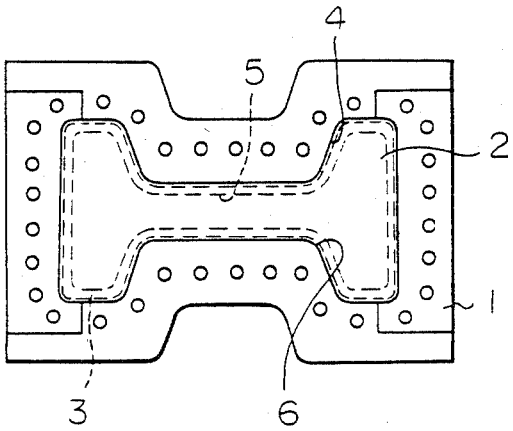
Fig. 5 (PRIOR ART)
FIG. 5 is a cross sectional drawing illustrating continuous casting of a beam blank and the essential parts of a continuous casting mold for a beam blank.

Referring to FIG. 5, as solidification advances in the continuous casting mold 1 for casting a beam blank, the solidified shell 3 of the beam blank 2 tends to shrink (also refer to FIGS. 1 and 2) while the solidified shell 3 is confined to the inner flange 4 of the continuous casting mold 1. The web shell 5 cannot, therefore, freely shrink. Since free shrinkage is impeded, a high restrained stress is locally generated in the web shell 5.

The thickness of the solidified shell 3 is generally not uniform (FIG. 4) because nonuniform cooling of the solidified shell is likely to occur usually due to the nonuniform introduction of casting powder and further because the gap as shown in FIG. 2 is formed due to shrinkage of the web shell 5. Stress concentration is therefore induced in the thin parts of the solidified shell and causes the formation of longitudinal web cracks, which are referred to as restrained cracks in the present specification.

The present inventors recognize that the effects of the conventional method described in items (a), (b) and (c) and the known continuous casting molds for beam blanks are not sufficient for preventing longitudinal web cracks and that a fundamental solution of the problem of restrained cracks is crucial for industrial production of beam blanks, particularly large beam blanks. For these reasons the present inventors conducted research.

It is an object of the present invention to provide a continuous casting mold for beam blanks in which the formation of restrained cracks at the fillet parts of said mold is prevented and in which the production of said mold is simplified. The continuous casting mold of the present invention effectively prevents the formation of restrained cracks not only in the dimensions of beam blanks presently produced but also in the larger dimensions of beam blanks.

A continuous casting mold for casting beam blanks according to the present invention is characterized in that the curved fillet parts of said mold are provided with a varying curvature which successively decreases in the casting direction in accordance with amount of free shrinkage of the solidified shell of the strand, thereby maintaining strain, which is formed due to the tensile stress applied to regions of the solidified shell from the inside of flange to the web part of said mold, to a level not exceeding the permissible upper strain limit for crack formation.

The term "the permissible upper strain limit for the crack formation" is difficult to define when one takes into consideration the fact that it varies depending upon the temperature distribution in the solidified shell and the strain velocity. The above-mentioned term defined herein is so low that there is no formation of cracks because the tensile stress due to restriction of the solidified shell to the mold wall during shrinkage of the solidified shell is low and thus allows plastic deformation of the solidified shell. In addition, according to the definition herein, when the strain exceeds the permissible upper limit for crack formation, the tensile stress mentioned above becomes so great that the strain formed in the solidified shell exceeds the plastic deformation range and thus results in the formation of cracks. The term "free shrinkage" used herein indicates shrinkage of the solidified shell under the presumption that the shell solidifies without being restrained to a continuous casting mold (FIG. 1).

The present invention is explained in detail with reference to FIGS. 6 through 16.

Figure 6:
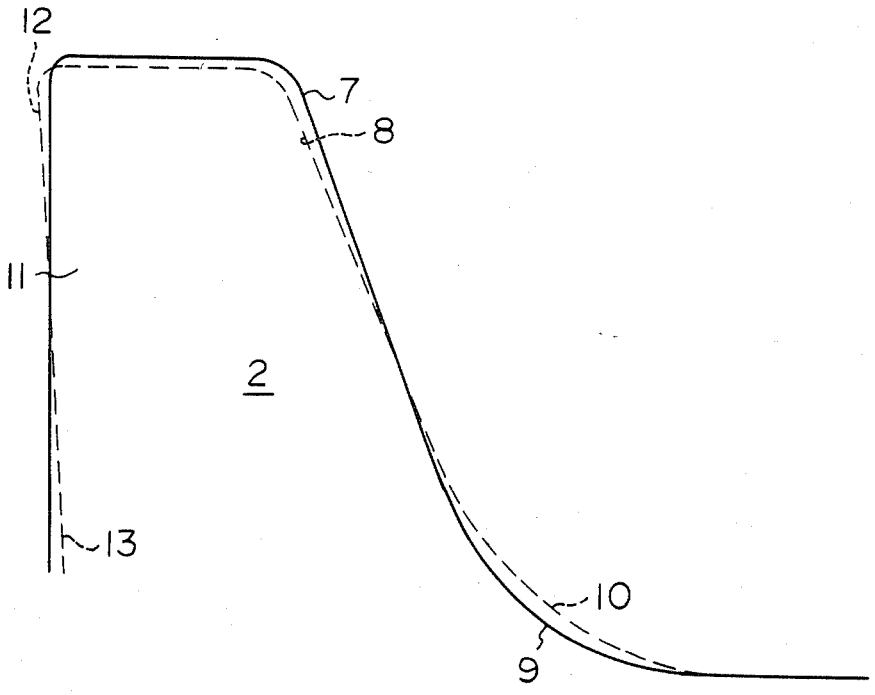
FIG. 6 is a schematic drawing illustrating how the cross sectional shape of a beam blank varies during casting.

Referring to FIG. 6, the solid line 7 denotes a partial or quarter cross section of a continuous casting mold at its upper part and the configuration of a beam blank 2 at the upper part of the continuous casting mold. On the other hand, the broken line 8 denotes the configuration of the beam blank 2 at a lower part of the continuous casting mold or a part close to the lower end of such mold, obtained as a result of calculation using the finite element method. As is clear from FIG. 6, the curved fillet part 9 of the beam blank 2 is initially of the inner shape of the continuous casting mold at its upper part. Subsequently, the shape of the curved fillet part 9 of the beam blank is deformed at a lower part of the continuous casting mold in such a manner that the beam blank is strongly forced against the inner wall of said mold. The curved fillet part 9 of the beam blank at the lower part is denoted by reference numeral 10. In other words, the curvature of the curved fillet part 9 of the beam blank successively varies at a vertical position of the continuous casting mold.

A flange part 11 of a beam blank 2 tends to bulge at the tip 12 with movement of the casting direction when the solidified shell is not subjected to restriction. However, when the solidified shell shrinks under restriction of the continuous casting mold, the tip 12 of the flange part 11 is forced against the inner wall of the mold, which in turn leads to separation of the center 13 of the flange part 11 from the inner wall of the mold. The variation in shape of the flange part 11 during casting, however, does not exert a great influence on the formation of cracks.

The curvature of the curved fillet parts of a continuous casting mold successively varies in accordance with amount of free shrinkage of the strand which is withdrawn from said mold at a steady speed, that is, the curvature mentioned above varies with the lapse of strand travelling time from the meniscus (time-$t_o$) to the lower most end (time-$t_n$) of said mold. As a result, no restriction force and no cracks are formed in the strand at the curved fillet and web parts of the beam blank.

Figure 7:
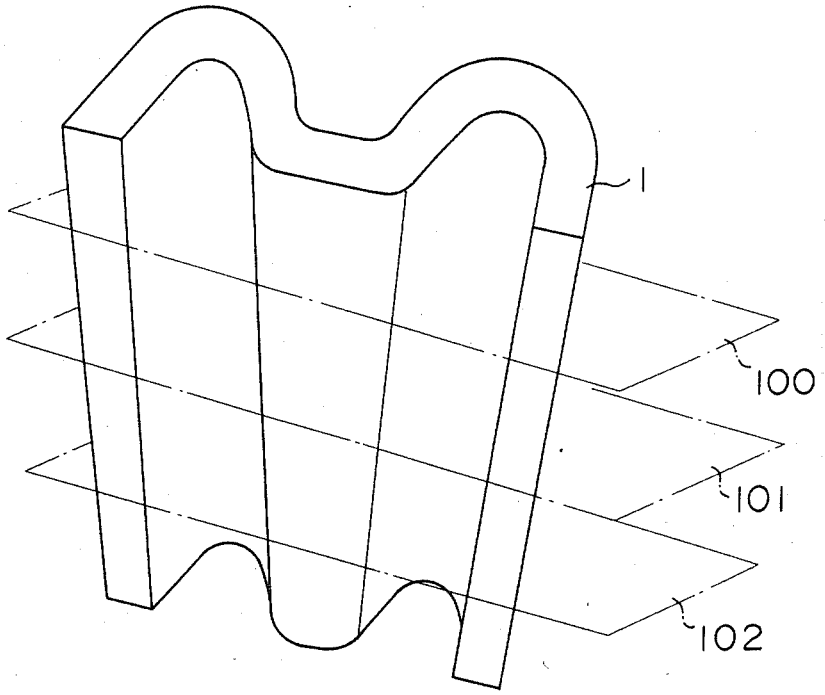
FIG. 7 is an elevational view of a partial cross section of a continuous casting mold according to an embodiment of the present invention.
Figure 8:
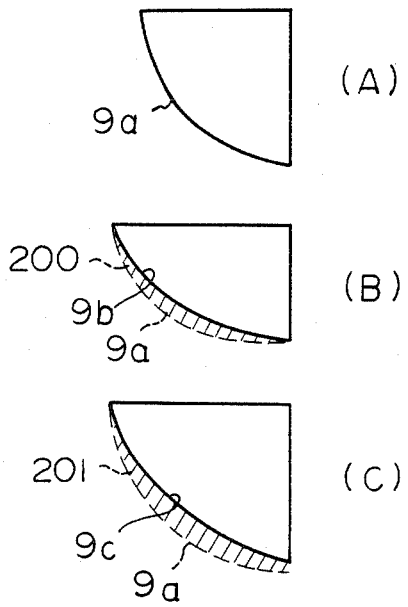
FIGS. 8(A, B, and C) is a schematic view illustrating how the arcs of a curved fillet of a continuous casting mold vary in the casting direction.

Referring to FIGS. 7 and 8, a curved fillet part of a continuous casting mold provided with varying curvature is schematically illustrated. Reference numeral 100 denotes the horizontal plane across the continuous casting mold 1 where the meniscus of the molten steel is formed. The curve of the fillet at the horizontal plane 100 is partially and schematically illustrated in FIG. 8A. Similarly, reference numeral 102 denotes the horizontal plane at the lowermost end of the continuous casting mold 1, and its curved fillet part is illustrated in FIG. 8C. Reference numeral 101 denotes a horizontal plane virtually centrally located between the horizontal planes 100 and 102, and its curved fillet part is illustrated in FIG. 8B. The solid line 9*a* of FIG. 8A indicates the shapes of the curved fillet parts of both a continuous casting mold 1 and a beam blank (not shown in FIGS. 7 and 8), the shapes of which two parts thus coincide with one another. In FIG. 8B, the curved fillet part 9*b* of a continuous casting mold is displaced inwardly relative to the above-mentioned solid line 9*a* in accordance with the amount of free shrinkage of the web, which is indicated by the hatched region 200. In other words, the curved fillet part 9*b* is displaced backwards toward the center of the radius of the curvature, and the hatched region 200 formed due to the backward displacement corresponds to the amount of free shrinkage induced by the solidification in FIG. 8B (at the horizontal plane 101), which is more advanced than that in FIG. 8A (at the horizontal plane 100). In FIG. 8C, the curved fillet part 9*c* of the continuous casting mold is further backwardly displaced toward center of the curvature because free shrinkage further develops and the amount of free shrinkage corresponds to the hatched region 201. As will be understood from FIGS. 8A, B and C, the amount of free shrinkage of the web shell, which increases in accordance with solidification, is successively absorbed by the varying curvature of the curved fillet part of a continuous casting mold. This is an essential feature of the present invention, and the varying curvature can be obtained by calculation based on such predetermined casting parameters as the mold format, cooling and casting condition of the molten steel and the temperature of the molten steel, and by correcting the calculated value based on the results of actual casting. A slight difference between the variation in the curvature and the variation in the amount of free shrinkage may, however, be allowed and there is no need for achieving a geometrically strict equality between said variations.

It is now described by way of example how to determine the variation in the curvature of the fillet part of the continuous casting mold.

Figure 9:
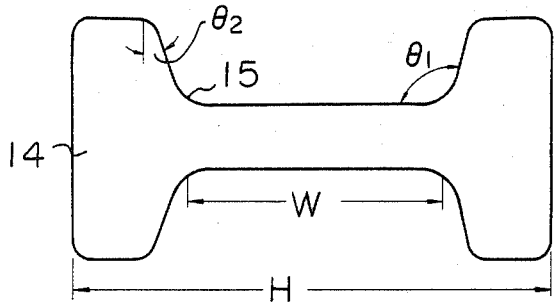
FIG. 9 is a schematic cross sectional view of a beam blank.

The beam blank 14 shown in FIG. 9 has a web height (H) of 800 mm, an inner web height (W) of 500 mm, a fillet angle ($\theta_1$) of 120°, and a slanted angle ($\theta_2$) of the inner flange of 30°. The curved fillet parts 15 of the continuous casting mold have a curve which is approximately a circular arc. The effective length or the length from the meniscus to the lower end of the continuous casting mold is 700 mm, and the withdrawal speed is 0.9 m/min. The temperature of the solidified shell is 1500° C. at the meniscus and is 1200° C. at the lower end of the continuous casting mold. The amount of free shrinkage ($\Delta l$) in the above-described casting parameters is:

$$\Delta l = 500 \times (1500 - 1200) \times 16 \times 10^{-6} = 2.4 \text{ mm} \quad (1)$$

wherein the thermal expansion coefficient of the solidified shell is $16 \times 10^{-6}$.

Figure 10:
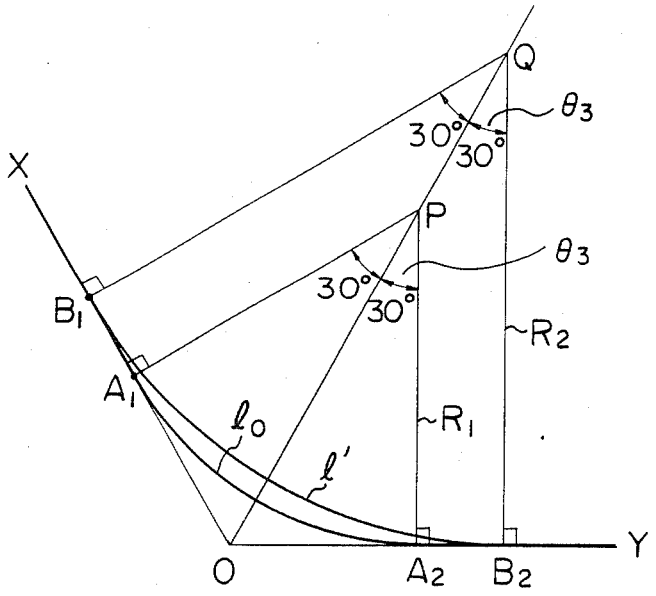
FIG. 10 shows the curves of a fillet of a continuous casting mold at its meniscus and lowermost part.

The curves of the curved fillet parts can be obtained as explained with reference to FIG. 10, in which the curves at the meniscus and lowermost end of the continuous casting mold are shown in a plan view. The curved fillet part of the continuous casting mold is curved at the meniscus, as shown by the circular curve ($l_0$) which has a radius of curvature $R_1$ (69 mm) drawn around its center at point (P), while the curved fillet part is curved at the lower end of said mold, as shown by the circular curve ($l'$) which has a radius of curvature $R_2$ (80 mm) drawn around its center at point (Q). Point (O) denotes the point of intersection of the prolongation of the inner side surface (X) of the flange with the prolongation of the web surface (Y), namely an imaginary point where both prolongations intersect with one another. The circular curve ($l_0$) osculates to said surfaces X and Y at points $A_1$ and $A_2$, respectively, while the circular curve ($l_1$) osculates to said surfaces X and Y at points $B_1$ and $B_2$, respectively.

When $\Delta l_M$ is defined by the difference of the length from $B_1 \rightarrow A_1 \rightarrow A_2 \rightarrow B_2$ and the length from $B_1$ to $B_2$, $$\begin{aligned} \Delta l_M &= (\overline{B_1A_1} + \widehat{A_1A_2} + \overline{A_2B_2}) - \widehat{B_1B_2} \quad (2) \\ &= \{2(\overline{DB_1} - \overline{OA_1}) + A_1A_2\} - \widehat{B_1B_2} \\ &= \left\{ 2(80 - 69)\tan 30^\circ + \frac{2\pi \times 69}{6} \right\} - \frac{2\pi \times 80}{6} \\ &= 12.69 + 72.22 - 83.73 = 1.18 \text{ (mm)} \end{aligned}$$

In the formula, $A_1A_2$ and $B_1B_2$ indicate the length of the circular curves $l_0$ and $l_1$, respectively.

Generally speaking, the amount of free shrinkage ($\Delta l$) can be calculated by means of the formula (1), while the radius of curvature $R_2$ at the lowermost part of the mold and the distance of $\overline{OB_1}$ ($\overline{OB_2}$) can be predetermined from the dimensions of the strand. In this case, $\overline{OA_1}$ and $\widehat{A_1A_2}$ given in the formula (2) remain unknown but can be reduced to a function formula of the radius of curvature $R_1$ when predetermining the angle $\theta_3$, which is half of the central angle at the fillet part of the continuous casting mold. By so obtaining the radius of curvature $R_1$, the amount of free shrinkage at either side of the web parts of the continuous casting mold, i.e. $\Delta l/2$, can be virtually equalized to $\Delta l_M$, i.e. the difference between the length from $B_1 \rightarrow A_1 \rightarrow A_2 \rightarrow B_2$ and the length from $B_1$ to $B_2$, so that the danger of the formation of restrained cracks can be eliminated.

Now the curvature of the curved fillet part is calculated by utilizing a formula conventionally used in the continuous casting of slabs for calculating taper.

The taper of the slab mold is represented by the following formula (3):

$$T = \frac{BL}{2L'}\left\{1 - \frac{\lambda}{1 + a(T_0 - T_1)}\right\} \quad (3)$$

In the formula (3), T represents taper in mold at one of the short sides of the strand; "a" represents the thermal expansion coefficient of the slab; B represents the casting width; $T_0$ represents the surface temperature of the strand at the meniscus; L represents the length of the continuous casting mold; $T_1$ represents the surface temperature of the strand at the lowermost part of the continuous casting mold, L' represents the length from the meniscus to the lowermost part of the continuous casting mold; and λ represents the coefficient for compensating the air gap at the short sides due to bulging of the long sides of the strand.

When the taper is to be determined, taking into consideration the amount of free shrinkage of the strand, the formula (3) can be simplified, as shown in the following formula (4) because region of the mold from the meniscus to its lowermost part has to do with the amount of free shrinkage.

$$T' = \frac{B}{2}\left\{1 - \frac{\lambda}{1 + a(T_0 - T_1)}\right\} \quad (4)$$

The amount of free shrinkage (T') of a beam blank is determined by the formula (4), wherein B indicates the inner web height. An example of the amount of free shrinkage (T') is calculated in the case of: B=500 mm; λ=0.998; a=16×10$^{-6}$; $T_0$=1500° C.; and, $T_1$=1200° C.

$$T' = \frac{500}{2}\left\{1 - \frac{0.998}{1 + (16 \times 10^{-6} \times 300)}\right\}$$

$$= 250\left\{1 - \frac{0.998}{1.0048}\right\} = 250 \times 0.00677 = 1.693$$

The amount of free shrinkage and the radius of curvature of the curved fillet parts of the continuous casting mold are calculated as illustrated below, taking into consideration the fact that the half angle ($\theta_3$) of the central angle at one curved fillet part (FIG. 10) is changed depending upon the slanted angle ($\theta_2$) (FIG. 9) of the inner flange, as shown in Table 1.

TABLE 1

| | | | | | | | | | | | |
|---|---|---|---|---|---|---|---|---|---|---|---|
| $\theta_2$: Slanted Angle of Inner Flange | 20° | 21° | 22° | 23° | 24° | 25° | 26° | 27° | 28° | 29° | 30° |
| $\theta_3$: Half Angle ($\theta_3$) of Central Angle at Curved Fillet | 35° | 34.5° | 34° | 33.5° | 33° | 32.5° | 32° | 31.5° | 31° | 30.5° | 30° |

TABLE 1-continued

| Part |
|---|

The amount of displacement of the curved fillet parts due to variation in the radius of curvature of this part can be expressed by the following formula:

$$\Delta l_M = \{2(\overline{OB_1} - \overline{OA_1}) + \widehat{A_1A_2}\} - \widehat{B_1B_2} \quad (5)$$

$$= \left\{2(R_2 - R_1)\tan\theta_3 + R_1\frac{2\pi\theta_3}{180}\right\} - R_2\frac{2\pi\theta_3}{180}$$

The radius of curvature ($R_1$) at the meniscus, which satisfies the relationship of $\Delta l_M$=T', is obtained by the following formula:

$$\Delta l_M = 2R_2\tan\theta_3 - 2R_1\tan\theta_3 + R_1\frac{2\pi\theta_3}{180} - R_2\frac{2\pi\theta_3}{180}, \quad (6)$$

wherein it is presumed that: $R_2$=80 mm and $\theta_3$=34.5°.

Accordingly, $$T' = 1.693 = (2 \times 80 \times 0.6873) - (2R_1 \times 0.6873) + (1.2037R_1) - (1.2037 \times 80)$$
$$1.693 = 109.968 - 1.3746R_1 + 1.2037R_1 - 96.296$$
$$0.1709R_1 = 11.979$$
$$R_1 = 70.09 \text{ mm}$$

When one presumes that the amount of free shrinkage linearly changes in the casting direction of the continuous casting mold, the amount of free shrinkage in the region centrally located between the meniscus and the lowermost part of said mold is half of the above mentioned T40 . Therefore, $$T'' = T' \times \tfrac{1}{2} = 1.693 \times \tfrac{1}{2} = 0.8465 \text{ mm.}$$

The radius of curvature ($R_3$) at the above-mentioned region, in which $\Delta l_M$=T'' . . . (7), is realized by the following formula:

$$\Delta l_M = 2R_2\tan\theta_3 - 2R_3\tan\theta_3 + R_3\frac{2\pi\theta_3}{180} - R_2\frac{2\pi\theta_3}{180} \quad (8)$$

$$0.8465 = (2 \times 80 \times 0.6873) - (2R_3 \times 0.6873) + (1.2037R_3) - (1.2037 \times 80)$$
$$0.8465 = 109.968 - 1.3746R_3 + 1.2037R_3 - 96.296$$
$$0.1709R_3 = 12.8255$$
$$R_3 = 75.05 \text{ mm}$$

$$\text{Therefore, } \frac{(R_1 + R_2)}{2} = R_3.$$

The radius of curvature ($R_0$) of the curved fillet parts at the uppermost part of the continuous casting mold is obtained by the following formula:

$$R_0 = R_1 - \frac{R_2 - R_1}{L'} \times (L - L') \quad (9)$$

$$= 70.09 - \frac{80 - 70.09}{700} \times 100 = 68.67 \text{ mm}$$

In a case where the constants of the formula (4) have the following values: λ=0.998; a=16×10$^{-6}$; $T_0$=1500° C.; B=500 mm; and, $T_1$=1200° C., and the radius of curvature ($R_2$) is constant or 80 mm, the radius of curvature ($R_1$) is obtained by the formula (5) as follows.

| $\theta_2$ | $\theta_3$ | $R_1$ (mm) |
|---|---|---|
| 20° | 35° | 70.56 |
| 21° | 34.5° | 70.09 |
| 22° | 34° | 69.60 |
| 23° | 33.5° | 69.08 |
| 24° | 33° | 68.51 |
| 25° | 32.5° | 67.95 |
| 26° | 32° | 67.29 |
| 27° | 31.5° | 66.63 |
| 28° | 31° | 65.95 |
| 29° | 30.5° | 65.13 |
| 30° | 30° | 64.35 |

Figure 11:
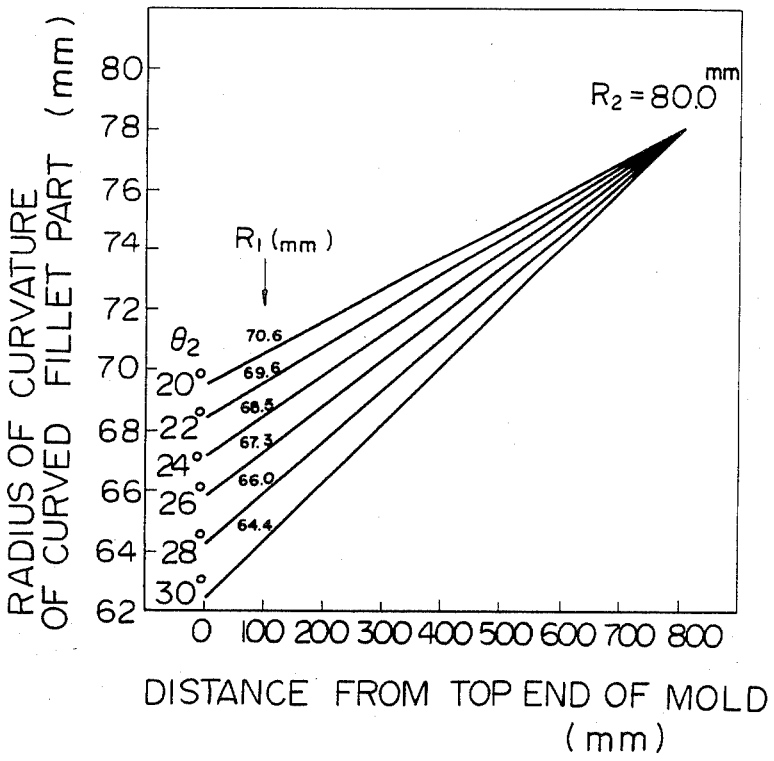
FIGS. 11 through 13 are graphs indicating the relationship between the radius of the fillet and the distance from the top end of a continuous casting mold.
Figure 12:
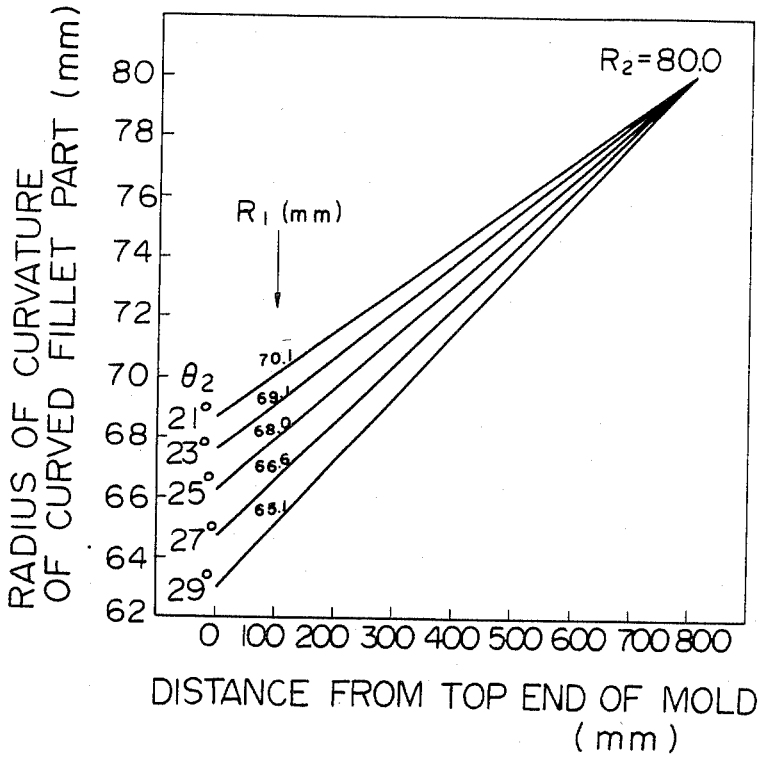

Referring to FIGS. 11 and 12, it is illustrated, in the case where $\Delta l_M$ and $R_2$ are constants, i.e. 1.693 mm and 80.0 mm, how the inner radius of the curved fillet parts varies in the vertical direction of the continuous casting mold with a variation in $\theta_2$, i.e. the slanted angle of the inner flange.

Figure 13:
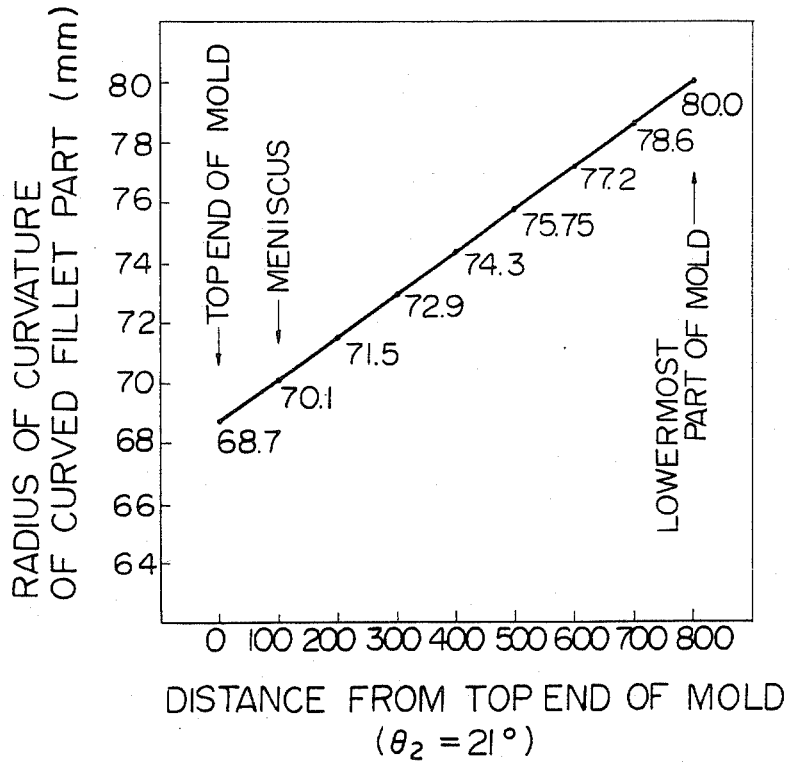

Referring to FIG. 13, it is illustrated, in the case where $\Delta l_M = 1.693$ mm, $R_2 = 80.0$ mm, the length of the mold is 800 mm, the distance from the top end of the mold to the meniscus is 100 mm, and $\theta_2 = 21$, how the inner radius of the curved fillet part varies in the vertical direction of the continuous casting mold.

Figure 14:
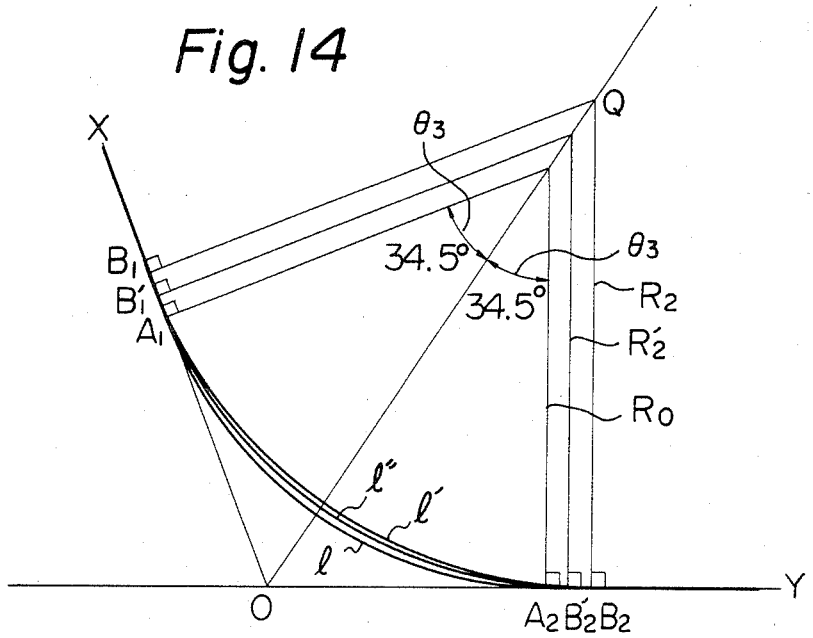
FIG. 14 is a schematic drawing illustrating the displacement of the bending points of a solidified shell.
Figure 15:
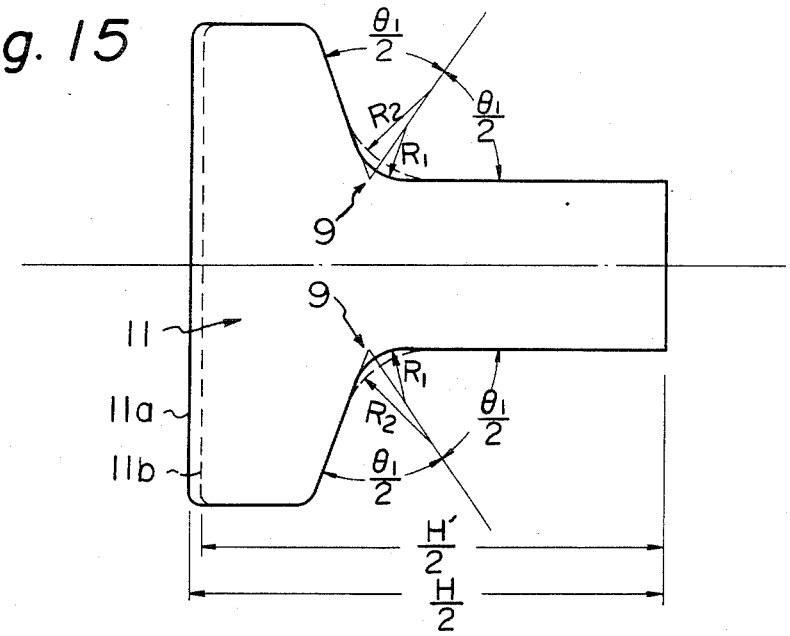
FIG. 15 is a drawing of a half of a continuous casting mold with a tapered flange.
Figure 16:
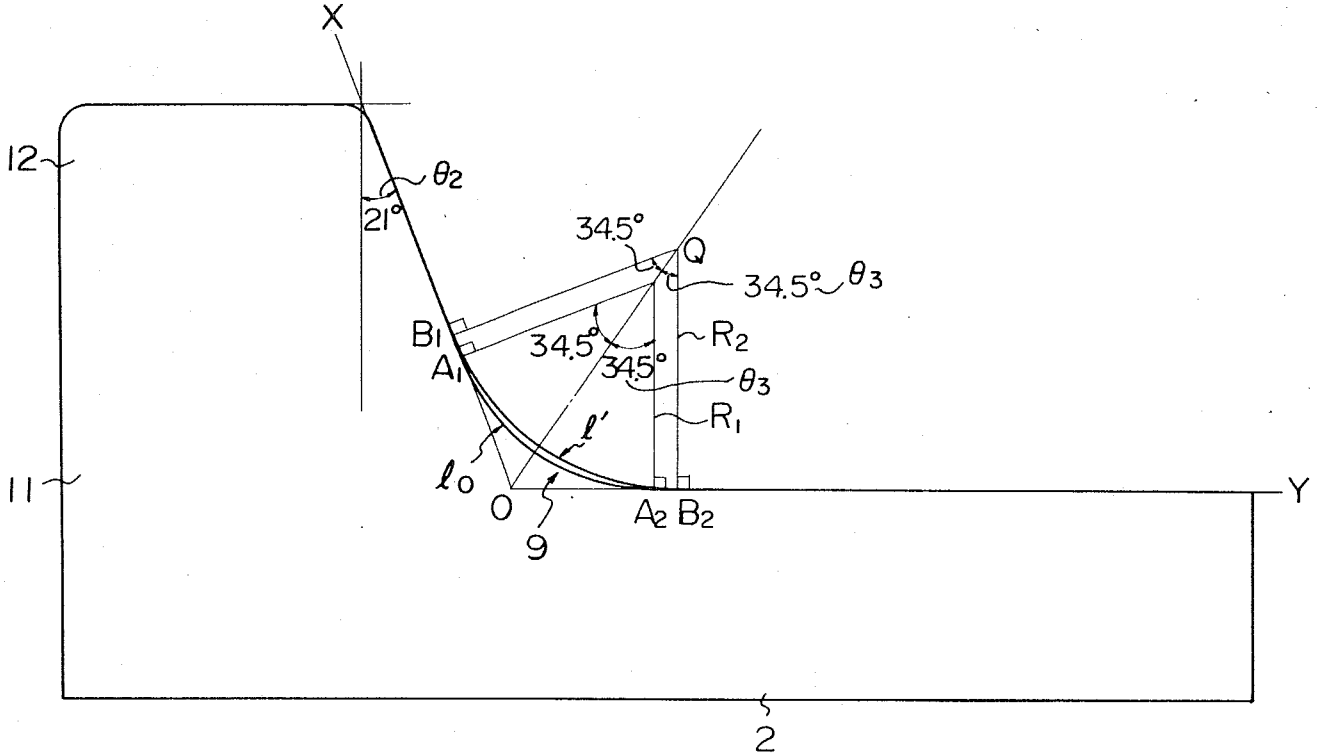
FIG. 16 is a drawing of a quarter of a continuous casting mold according to an embodiment of the present invention.

The variation in curvature of the arc defined by the curved fillet parts of the continuous casting mold, which variation is successively in accordance with the amount of free shrinkage of the web of the strand according to the present invention, is effected in the vertical direction of the continuous casting mold at least from the meniscus region to the lowermost part of said mold. Such variation can be realized, for example, by successively and continuously varying the arc length of the curved fillet parts of the continuous casting mold, thereby rendering the shape of such curved fillet parts to vary depending on the variation in shape of the curved fillet parts of the beam blank and thus shielding the curved fillet parts of the beam blank from the action of the disadvantageously high restriction force. Alternatively, the curvature can be continuously varied from $1/R_1$ to $1/R_2$. In this case, as shown in FIG. 14, the straightening points of the solidified shell at the flange side are displaced in the sequence of $A_1 \rightarrow B_1' \rightarrow B_1$, together with the variation in curvature mentioned above, so that a continuous and multi-point bending or straightening of the solidified shell takes place. Incidentally, the web height W measured from the starting point of point "O" in FIG. 14 does not vary when the horizontal plane across the continuous casting mold at which the web height W is measured, varies along a vertical position.

Instead of a continuous change in curvature, the curvature can be divided into from 5 to 20 stages or steps, and the so divided curvatures are assigned to the curved fillet parts of the continuous casting mold in the vertical direction of the mold. Any other variation in curvature which allows free shrinkage of the web part to such an extent that restrained cracks are not formed can be employed for defining the curved fillet parts of the continuous casting mold.

The curve of the curved fillet parts of the continuous casting mold as seen in a horizontal plane may be defined by a circular arc having such a plurality of curvatures that when the solidified shell is deformed during straightening, the bending moment of the solidified shell is decreased as much as possible. In the case when the circular arcs $l_0$ and $l'$ mentioned above are defined by curves having a plurality of curvatures, the circular arcs, for example the one having a radius of curvature ($R_0$ shown in FIG. 14), do not osculate with the line OX or OY, but circular arcs having a radius curvature $R_{0(n)}$, wherein $R_0 < R_{0(n)} < \infty$ and n is an integer greater than one, are inserted between the circular arc ($R_0$) and the line OX or OY. Due to the circular arcs having a radius of curvature $R_{0(n)}$, possibility of the formation of restrained cracks can be further decreased since the bending of the solidified shell is not effected at one point but is effected at a plurality of points or "n" points.

The circular arcs of the curved fillet parts of the continuous casting mold, for example circular arcs having radiuses of curvature $R_1$ and $R_2$ (FIG. 10), desirably have their centers on the central line OQ. If these centers shift from the central line, curves with circular arcs cannot be formed, and the $\Delta l_M$ decreases. This is not meritorious but allows to mitigate the restriction or allows the free shrinkage at the curved fillet parts to some extent.

A variation in curvature in the casting direction according to the present invention may be effected so that the curve of the fillet part of the continuous casting mold as seen in its vertical plane follows a quadratic equation or an equation of a higher degree.

The curved fillet parts of the continuous casting mold may be defined by a single circular curve as seen in its horizontal plane or may be defined not by a single circular curve but by a quadratic equation or an equation of a higher degree as seen in the horizontal plane. The curved fillet parts shown in FIG. 6 are defined by an equation of a higher degree, and a multi point bending of the solidified shell is effected in the horizontal plane.

The continuous casting mold for beam blanks according to the present invention may have an optional shape at parts other than the curved fillet parts, and, particularly, the former parts may be of any optionally varied shape in the casting direction. However, the outer flange parts of the continuous casting mold is preferably provided with a taper, (e.g. FIGS. 15 and 16) which is calculated by the formula (3) in which the casting width B is defined as the web height, and thereby supports the collapsed solidified shell by means of the flange surfaces of said mold. The parts other than the curved fillet parts, and occasionally the flange surfaces, of the continuous casting mold have no relationship to the formation of restrained cracks as a rule. The web part may, however, be provided with a smaller taper in the casting direction than that calculated by means of the formula (3).

The continuous casting mold for beam blanks according to the present invention is effective for decreasing the stress concentration in the thin parts of the solidified shell and thus decreasing restrained cracks regarding the continuous casting of beam blanks of any dimension, particularly beam blanks of a large dimension or those having a web height exceeding 775 mm. That is, although the variation in curvature of the curved fillet parts, in the casting direction demonstrates meritorious effects no matter what the cross sectional dimension of the continuous casting mold is, such variation demonstrates remarkably a meritorious effect in a mold having a greater web height.

The dimensions of a continuous casting mold for beam blanks have been described hereinabove. It is to be noted that the features of the continuous casting mold not described hereinabove, such as the cooling-water conduits of the mold, the oscillation mechanism, the length of the mold, a solid or built-up structure, and the accompanying members of the mold, are not different from those of the known continuous casting molds for casting beam blanks.

The improvement of the continuous casting mold for casting beam blanks according to the present invention resides, as will be understood from the descriptions hereinabove, essentially in the formation of the shape of the curved fillet parts of mold, and, therefore, such mold is easy to manufacture, is highly effective for preventing restrained cracks, and is remarkably useful for the casting of crack-free beam blanks.

We claim:

1. In a method for continuously casting a steel beam blank, in which:

a continuous casting mold is provided having a vertically opening cavity with a web part constructed and arranged to form the web of the blank, a plurality of flange parts constructed and arranged to form a plurality of flanges of the blank, and a plurality of concavely-curved fillet parts constructed and arranged to form respective transitional, concavely-curved fillet parts of the blank where an inside of a respective said flange adjoining a respective tip of that flange blends into a respective flanking surface of said web;

molten steel is poured into said mold to establish and maintain a meniscus of molten steel in the mold near an upper end of the mold;

steel is cooled in the mold as it moves downwards, sufficiently to form a perimetrically intact, sufficiently supporting shell about a beam blank strand as such strand continuously emerges from a lower end of the mold and is withdrawn therefrom at a substantially steady speed, during which downward movement in the mold, the solidifying shell tends to shrink in transverse cross-sectional area at least partly as a result of solidification and cooling, an improvement aimed at preventing the formation of restrained longitudinal cracks in the beam blank shell at the concavely-curved fillet parts of mold, comprising:

in connection with providing said mold, providing said concavely-curved fillet parts to progressively increase in radius of curvature and thereby decrease in magnitude of curvature at each of a plurality of successively lower imaginary transverse cutting planes of said mold cavity disposed between said meniscus and said lower end including at a plurality of levels where the steel is solidifying to form and increase the thickness of said shell, such progressive increase in radius of curvature being sufficient in magnitude and in progressiveness, taken together with any downward tapering of the flange parts and web part of the mold, to maintain strain which is formed due to tensile stress applied to regions of said solidified shell from inside of said flange parts to the web part of said mold, to a magnitude not exceeding the permissible upper strain limit for crack formation in the beam blank being cast.

2. A continuous casting mold for casting a steel beam blank, comprising:

a web part;

a plurality of curved fillet parts; and a plurality of flange parts;

all these parts being arranged to define a mold cavity constructed and arranged for forming a strand;

said curved fillet parts being provided with a varying curvature which is successively decreased in a casting direction in accordance with an amount of free shrinkage of a solidified shell of the strand, thereby maintaining strain which is formed due to tensile stress applied to regions of a solidified shell of said strand, from inside of said flange parts to the web part of said mold, to a level not exceeding the permissible upper strain limit for crack formation in the steel beam blank being cast.

3. A continuous casting mold according to claim 2, wherein:

said flange parts of said mold are provided with a taper in the casting direction.

4. A continuous casting mold according to claim 2 or 3, wherein:

the web part of said mold is provided with a taper in the casting direction.

5. A continuous casting mold according to claim 2 or 3, wherein:

the inside of each of said flange parts of said mold is defined by a curve which is formed by connecting a plurality of circular arcs l, curvatures of said circular arcs being determined in such a manner that the bending moment of the solidified shell can be decreased.

6. A continuous casting mold according to claim 2, wherein:

said mold cavity has a web height W which exceeds 775 mm.

7. A continuous casting mold according to claim 2, wherein:

variation in said curvature in the casting direction satisfies the following formula:

$$\Delta l \approx \tfrac{1}{2}\left\{ 2(R_2 - R_1)\tan\theta_3 + R_1\frac{2\pi\theta_3}{180} \right\} - R_2\frac{2\pi\theta_3}{180},$$

wherein: $\Delta l$ is amount of free shrinkage determined by casting parameters; $R_1$ is the radius of said curvature of any one of said curved fillet parts at the lowermost part of said mold cavity, predetermined by strand format; $R_2$ is the radius of said curvature of any one of said curved fillet parts at a meniscus; and $\theta_3$ is one-half of the central angle at the curved fillet parts of said mold cavity.

8. A continuous casting mold according to claim 2, wherein:

said curvature varies continuously.

9. A continuous casting mold according to claim 2, wherein:

said curvature varies in a stepwise manner.

* * * * *